United States Patent [19]

Walsh

[11] 4,275,327

[45] Jun. 23, 1981

[54] INCANDESCENT ELECTRIC LAMP WITHHEAT RECOVERY MEANS

[75] Inventor: Peter Walsh, Stirling, N.J.

[73] Assignee: Duro-Test Corporation, North Bergen, N.J.

[21] Appl. No.: 955,974

[22] Filed: Oct. 30, 1978

[51] Int. Cl.[3] ..... H01K 1/32

[52] U.S. Cl. ..... 313/111; 313/112; 313/114; 313/116

[58] Field of Search ..... 313/111, 112, 113, 114, 313/116

[56] References Cited

U.S. PATENT DOCUMENTS

| | | | |
|---|---|---|---|
| 1,859,601 | 5/1932 | Rice | 313/111 X |
| 2,110,590 | 3/1938 | Cook, Jr. | 313/114 |
| 2,394,495 | 2/1946 | Smith | 313/111 |
| 3,209,188 | 9/1965 | Freeman | 313/112 X |
| 4,039,878 | 8/1977 | Eijkelenboom et al. | 313/112 X |

*Primary Examiner*—Palmer C. Demeo

*Attorney, Agent, or Firm*—Darby & Darby

[57] ABSTRACT

An incandescent electric lamp utilizing an infrared (IR) reflector for directing IR energy back to the filament to increase its operating efficiency in which a reflector is used to redirect circulating infrared energy back to the wall of the envelope where it then can be redirected back to the filament, or reflected directly back onto the filament.

21 Claims, 5 Drawing Figures

INCANDESCENT ELECTRIC LAMP WITHHEAT RECOVERY MEANS

This invention relates to incandescent electric lamps and more particularly to an incandescent electric lamp having a coating on the inner or outer wall of the envelope thereof to reflect infrared (IR) energy back to the filament to increase its operating efficiency. The principles of such lamps have been discussed for some time and, in general, such a lamp includes a filament which is located within an envelope at a position such that IR energy emitted by the filament will be reflected from an IR reflecting coating on the envelope back to the filament. The coating is designed to transmit the visible light. The envelope is of suitable shape to reflect the IR energy back to the filament, for example, spherical or ellipsoidal. The filament absorbs the reflected IR energy, which tends to increase its operating temperature, thereby decreasing the amount of input power needed for the lamp to operate at a given temperature. In this manner the lamp efficiency is increased.

In the operation of such lamps, it has been discovered that a considerable amount of IR energy is circulating in a mode which generally follows the contour of the lamp envelope. The IR energy (heat) in the circulating mode, not only can damage the arbor on which the filament is mounted, but more importantly, it detracts from the IR energy available to heat the filament. To overcome both of these problems, the preferred embodiment of the present invention utilizes a reflector in the envelope neck area which is shaped to redirect the IR energy which is in a circulating mode back onto the filament and/or the wall of the envelope where it will then be reflected onto the filament to increase its heating in the manner intended.

In another embodiment of the invention, an arrangement is provided for generating circulating modes of IR energy in a lamp where such modes are not normally formed. The energy in these generated modes encounters the reflector and it is reflected to the filament and/or envelope wall in the manner previously described. This arrangement provides a more efficient return path for the IR energy reflected from the envelope wall which does not impinge on the filament.

It is therefore an object of the present invention to provide an incandescent electric lamp having an IR reflective coating in which means are provided for reflecting back to the filament IR energy travelling in a circulating mode.

A further object is to provide an incandescent lamp having an IR reflective coating in which a reflector is located adjacent the neck portion of the envelope to redirect IR energy travelling in a circulating mode back to the filament.

A further object is to provide an incandescent lamp with an IR reflective coating, in which means are provided to generate circulating modes of energy and to redirect the circulating modes back to the envelope wall and/or the filament.

Other objects and advantages of the present invention will become more apparent upon reference to the following specification and annexed drawings, in which.

Figure 1:
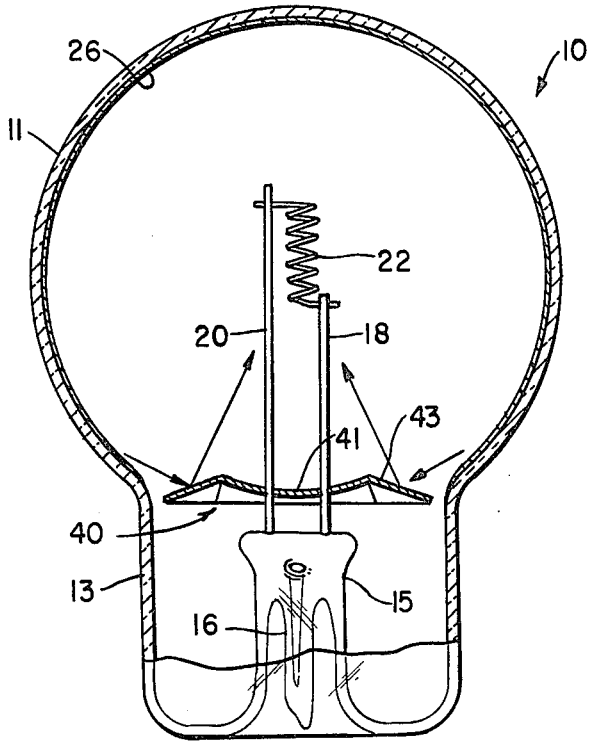
FIG. 1 is an elevational view of an incandescent electric lamp in accordance with the invention.

FIG. 1 shows an incandescent electric lamp 10 illustrating the principles of the subject invention. The lamp includes a generally spherical envelope 11 of glass or other suitable material. The envelope 11 has a neck 13 which includes a re-entrant stem 15 in which there is a tubulation 16 for exhausting the interior of the envelope. The details of such tubulation are conventional and do not form part of the present invention.

Stem 15 serves as an arbor for holding a pair of lead-in wires 18 and 20 which are brought out through the stem to an electrical contact member, such as a screw base or bayonet-type base, which is not shown for purposes of clarity. Mounted to the lead-in wires 18 and 20, which are relatively stiff, is a filament 22. The filament shown as being elongated and vertically mounted. The filament may also be mounted horizontally, that is, perpendicular to the direction shown in FIG. 1. Other types of filament can be used, the type of filament used not being critical to the invention. The filament is of a construction suitable for the operating parameters of the lamp and can be, for example, of either plain or doped tungsten. The lamp can be either evacuated to a high vacuum or filled with an inert operating gas, such as argon or krypton or combinations of these and other gases. These details, in themselves, also form no part of the present invention.

The spherical portion of the lamp envelope 11 preferably has thereon, either on the inside or the outside, a coating 26 which is illustratively shown as being on the inside of the lamp. The coating transmits the visible energy and also reflects IR energy produced by the filament. The efficiencies of the coating in both directions, that is, IR reflectivity (R) and visible transmissivity (T), are made as high as possible. It is preferred, for example, that the coating transmit at least about 60% of the energy in the visible range and reflect in excess of about 70% of the energy in the IR range produced by the filament. One coating suitable for doing this is formed of three discrete film layers of $TiO_2/Ag/TiO_2$ having thicknesses of about 300 A° of $TiO_2$, 210 A° of Ag and 300 A° of $TiO_2$ for a lamp having a filament designed for operation at about 3000° K. Other coatings can be used, for example silver or gold alone, or $TiO_2$ alone, although these are not as efficient. The subject invention is not restricted to any particular envelope shape or type of coating, nor is it restricted to having the coating placed on the inside or the outside of the envelope or having the coating over the entire surface of the envelope. The filament is located in the envelope to have a large portion of the IR energy reflected from the coating back onto the filament. The absorbed infrared power tends to raise the operating temperature of the filament and increases the overall efficiency of the lamp by requiring a lower filament input power for a desired filament temperature.

In an IR reflecting type lamp of a type previously described, it has been found that there is circulating mode, or modes, of IR energy which travel parallel to the envelope inner wall. This can be shown, for example, in a spherical envelope with IR reflective coating by extending an arbor on which the filament is mounted above what would be a continuation of the envelope spherical surface where it would cross the neck of the lamp. It is then found experimentally that the arbor, if unprotected, is subject to intense heating and at times, this heating is sufficient to melt the glass arbor. The circulating energy reduces the efficiency of the lamp since it is not reflected back to the filament and, consequently, cannot serve to raise its temperature in the manner desired.

The circulating modes are apparently analogous to "whispering modes" which are acoustical modes produced in a circular auditorium. These have previously been described and analyzed by Lord Rayleigh—see "The Theory of Sound", Rayleigh, Vol. II, page 126, republished by Dover, 1945.

It is believed that in an incandescent lamp there are two basic mechanisms which give rise to the circulating IR radiation modes. The first of these is a scattering of energy produced by the filament by individual irregularities on the wall of the envelope and diffractions by repeated irregularities. Once the scattered radiation has achieved a path somewhat parallel to the enclosure with its reflecting coating, the reflection coefficient of the enclosure approaches extremely close to unity. In addition, surface irregularities (which cause the circulation) become crowded together, in the line of sight of the scattered radiation, to dimensions smaller than a wavelength and the wall effectively acts as a smooth surface to the circulating modes.

Figure 2:
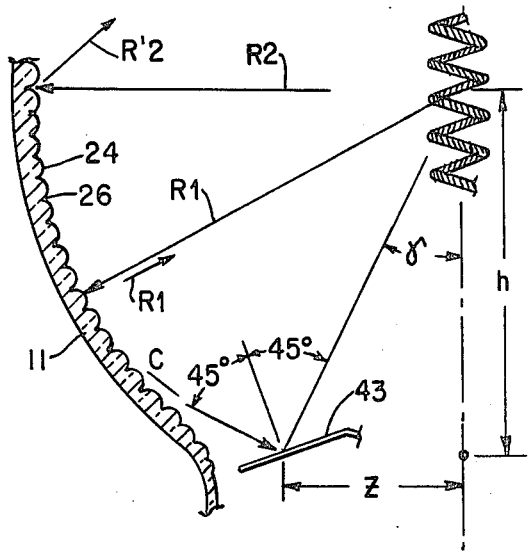
FIG. 2 is a diagram illustrating one mechanism by which circulating modes of energy are produced by surface irregularities of the lamp envelope and also illustrates the orientation of the radiation return reflector.

FIG. 2 shows how surface irregularities produce the circulating modes. In FIG. 2, the radiated rays from the filament are designated R and these are emitted in a direction generally radial from the filament to the coated envelope wall. If the surface of the envelope on which a ray is incident is normal to the ray, i.e., the wall is smooth, a ray (such as middle ray R1) would be reflected back directly to the filament to produce the increased heating. This is shown by the reflected ray R'1.

However, the surface of the envelope may not be totally optically smooth. As shown in FIG. 2, it can have hills and valleys 24 and 26, sometimes called striations, which are produced during the manufacture of the envelope. In the case of a ray such as R2 from the filament striking the side wall of the one of the striations 24, it would be reflected sideways as shown by the ray R'2.

If one assumes that $\alpha$ is the largest angle of inclination between the surface normal 28 and the non-normal incident radiation R, then the maximum deviation of an outgoing, or reflected, ray from the incident ray is $2\alpha$. Assuming that this same ray would strike a similar striation 24 on the opposite side of the envelope, each successive reflection adds $2\alpha$ to the angle of incidence with respect to the radius in a circular (spherical) enclosure. After n bounces of the enclosure walls, the angle $\beta_n$ with respect to the radius for the most deviated ray is:

$$\beta_n = 2N \tag{1}$$

This process continues until the line of sight of the ray is nearly parallel to the envelope surface at which point the height of the irregularity of the surface becomes smaller than the wavelength of the energy and the surface becomes effectively smooth to the energy.

For the extreme ray, it takes about $n_{max} = 90°/2\alpha$ bounces (where $\alpha$ is in degrees) to be converted into a circulating ray. If $\alpha = 1°$, for example, about 45 bounces would be needed.

Average rays, that is rays impinging at an angle somewhere between 0° and $\alpha°$, have a different history. Since the reflecting surface can be inclined toward or away from these rays, they have an even chance of increasing or decreasing their deviation. This is an attribute of a diffusion pattern process. In such a case, the angular deviation increases with the same deviation per bounce, $2\alpha$, but as the square root of the number of bounces. Hence, $$Bm = \sqrt{\eta 2\alpha}\text{, for an average ray} \tag{2}$$

Since the surface irregularities may not be uniform, $\alpha$ will also vary. Thus a few strongly inclined irregularities with large $\alpha$ can strongly influence the circulation mechanisms.

If the surface irregularities are repetitive, with an average spacing $S_1$, they act like a diffraction grating in addition to the surface reflection already discussed. When the spacing and/or shape of the irregularities are somewhat irregular, it can be shown that the two first order diffraction patterns will still be present but higher order patterns will occur in the reflection.

The diffraction effect will deflect an incident beam perpendicular to the line of the surface irregularity similar to the previous case, but at an angle $$\Delta\beta = \lambda / S_1 \tag{3}$$

The quantity $S_1$ is the diffraction spacing perpendicular to the line of sight where $$S_1 = S \cos \beta_n \tag{4}$$

It can be shown for an extreme ray that:

$$\Delta\beta = \frac{\beta_{n+1} - \beta_n}{(n+1) - n} = \frac{\lambda}{S\cos\beta_n} = \frac{d\beta}{dn} \tag{5}$$

Integration of (5) gives $$1 - \sin \beta_n = \lambda / sn \tag{6}$$

For $\beta_n = \pi/2$, the ray is parallel to the surface of the envelope. This requires $n_{max}$ bounces $$n_{max} = S/\lambda\text{, for an extreme ray} \tag{7}$$

This type of circulation mechanism is also really a diffusion process and the average deflection increases with $\sqrt{n}$. It would then be expected $$\sqrt{n_{max}} = \left(\frac{S}{\lambda}\right)^2 \tag{8}$$

In a typical envelope, the striations running along the equatorial region of the bulb would appear as likely candidates for both mechanisms. These striations appear somewhat repetitive. To the eye, S appears too large to make the diffraction phenomena operative but there could be very minute striations that are not apparent to the eye. Both mechanisms will gradually deflect radial rays into circulating paths which will ultimately run from the top of the bulb to the neck to be scattered or absorbed by the filament mount structure at a level parallel to the enclosure surface near the neck.

Returning to FIG. 2, the circulating rays are designated by the arrows bearing the letter C while a ray which has been reflected from the envelope wall, in the manner previously described, and misses the filament is designated R. The rays R eventually become the circulating rays C due to one or both of the mechanisms previously described.

Figure 3:
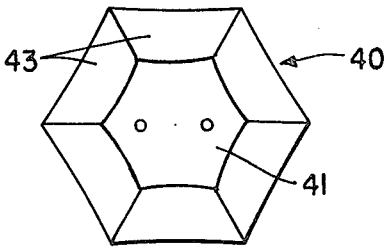
FIG. 3 is a top view of a form of reflector.

To reflect the circulating rays back to the filament, a radiation return reflector 40 is mounted, preferably on the lead wires 18,20. Alternate mountings could be directly to the stem 15 or to the envelope itself. As shown in FIGS. 1 and 3, reflector 40 has a concave central section 41 and skirt sectors 43 which extend outwardly and downwardly. The outer surfaces of sections 41 and 43 have an IR reflecting material thereon such as silver, polished aluminum, etc. Central section 41 is positioned with respect to the filament and has a radius of curvature such that IR energy incident thereto directly from the filament is reflected back to the filament for the purposes of heating as previously described.

Each of the sections 43 is located within the envelope at a point to intercept the circulating rays C of IR energy. Thus, for example, they would extend across a continuation of the inner spherical surface of the envelope 11. The segments 43 are inclined as indicated in FIG. 2. They are also curved and are substantially concave in shape to act as a cylindrical lens to focus radiation C onto the narrow dimension of the filament.

Figure 3A:
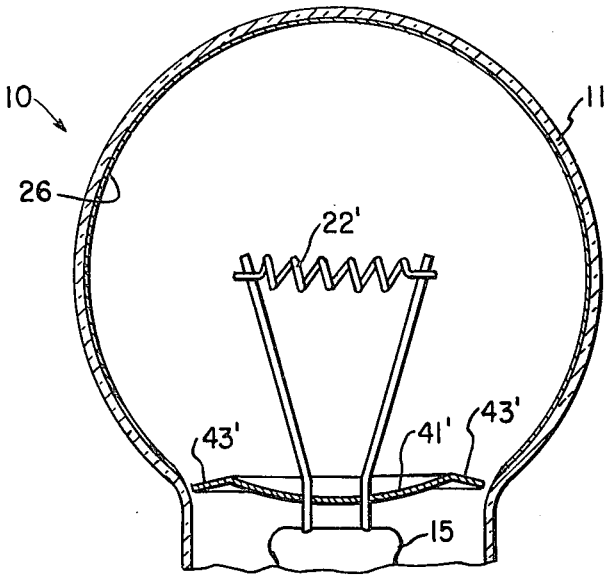
FIGS. 3A and 3B are side and top view of a part of a lamp having a horizontally mounted filament and a radiation return reflector.
Figure 3B:
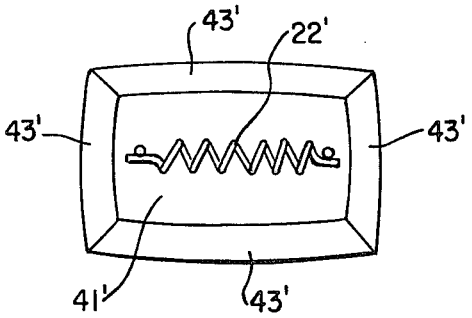

The axis about which the segments are designed to be substantially concave depends upon whether the filament is mounted vertically or horizontally. For a vertically mounted filament this axis is parallel to the inclined segment of FIG. 2. In the case of a horizontally mounted filament, the cylindrical axis is horizontal and the segments have a generally ellipsoidal shape which varies with position around the skirt in a manner designed to focus circulating rays onto both dimensions of the filament whose appearance varies when viewed from different positions around the skirt. This is shown in FIGS. 3A and 3B wherein the filament is designated 22' and the central and skirt sections of the reflector 41' and 43'. For vertically mounted filaments, focusing along the long dimension of the filament is possible, but may not be desirable since the return radiation from coating should more or less uniformly heat the filament. While six skirt sectors 43 are shown, it should be understood that there can be a lesser or greater number. The number depends on such factors as the size of the envelope and shape and location of the filament.

The radius of curvature r of a sector 43 of the return skirt is given by the lens formula $$f=qp/q+p=r/2 \quad (9)$$

The image distance is $q=EF=r/\cos\gamma$ while the exact values of the object distance, p, is not certain. If p is taken as $\frac{1}{2}$ the circumference of the bulb, $\frac{1}{2}\cong\pi R$, then $$r\cong R\pi/(1+\pi) \quad (10)$$

If a ray is not reflected by the reflector 40 back to the filament, it will impinge on the wall 11 and the reflection and mode generation will occur over again.

It also should be understood tht the higher the IR reflectivity of the coating and the smaller both its IR transmissivity and absorption, the greater will be the likelihood that the circulating modes will be produced and the higher will be the IR energy content of these modes.

For an ellipsoidal shaped envelope, the reflector would be of the same general configuration as reflector 40. The skirt sectors 43 would be shaped with the required lens configuration to reflect the circulating energy back to the filament. This general design principle applies to envelopes of other shapes.

The use of the radiation return reflector 40 returns to the filament the IR energy that initially missed it after being reflected from coating 26. In a lamp having a radiation return reflector, for it to have the maximum effect, radiation which once misses the filament should deliberately be dispersed into circulating modes as rapidly as possible.

Figure 4:
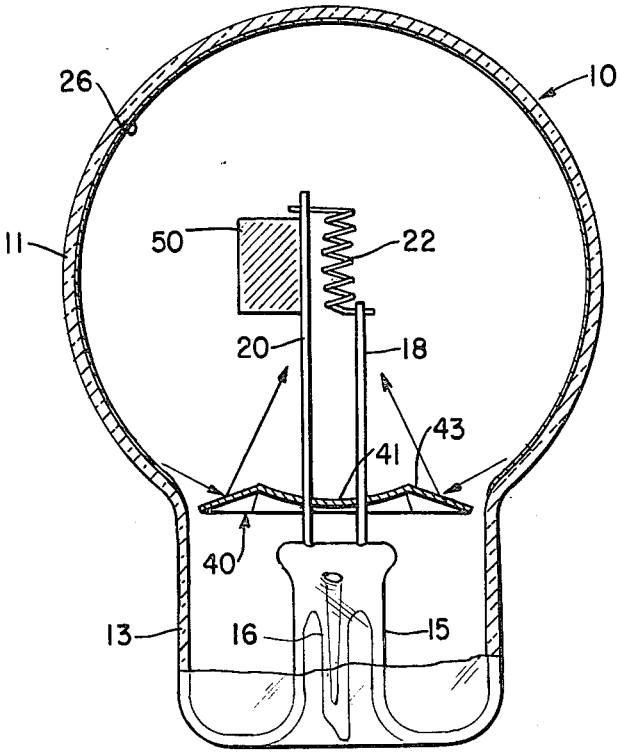
FIG. 4 is a view similar to FIG. 1, showing a structure for producing circulating modes.

Such arrangement for doing this is shown in FIG. 4. Here a suitable member for dispersing the IR rays which miss the filament is mounted adjacent the filament and designated by reference numeral 50. Member 50 can be, for example, an optical grating. Suitable optical gratings may be pieces of high temperature plastic material such as copolymer polypropolene and alkyd resin plastics, which are lined or scribed in a conventional manner to produce the optical grating. Alternatively, for example, the grating can be made of glass with ruled, etched or deposited grating lines. Another suitable member would be a piece of glass which deliberately has striations thereon such as 24 of FIG. 2.

The characteristics of the member 50 must be such that it does not interfere, or interferes as little as possible, with the direct return to the filament of the IR energy reflected from the envelope wall. This limits its location. Also, it should be capable of insertion into the lamp conveniently during manufacturing. In FIG. 4, the grating is shown attached to one of the filament leads 20 and is located spaced from and parallel to the filament. It is preferred that the grating lines, or whatever else is used to disperse the rays R, run somewhat horizontally so as to produce mode orders of circulating energy that will circulate from the top to the bottom of the lamp and thus intercept the radiation return skirt 40. The grating produces mode orders that are dispersed in a plane perpendicular to the grating lines. It is desirable to have the dispersed rays circulate around the envelope several times so they develop a good circulating mode structure before striking the radiation return reflector 40. They then can be focused accurately on the filament by the radiation return reflector. This means that grating need not be aligned fully horizontally.

It is preferred that the member 50 be aligned as precisely as possible to point radially from the filament. Then, the member intercepts substantially no rays which are directly returned from the bulb envelope to the filament. The only direct rays lost are those which would have struck the support lead. Thus, a properly aligned member 50 produces substantially no additional loss in the lamp. The radial extent of the member is limited by the size of the envelope neck opening through which it must be mounted.

The circulating modes are generally located within several millimeters of the inner wall of the envelope and will not normally be interfered with by the member 50. While member 50 is shown as being generally rectangular, it should be understood that other shapes are possible. However, in general, the member 50 should be made as thin as possible.

What is claimed is:

1. An incandescent electric lamp comprising:

an envelope;

a filament within said envelope, said filament producing energy in the visible range and in the infrared range when heated to incandescence, means connected to and adapted to supply electrical energy to said filament to cause it to incandesce, means on the wall of said envelope for reflecting infrared energy produced by the filament back thereto, a portion of the infrared energy reflected from the envelope wall forming a mode which circulates throughout the envelope in a path generally parallel to the envelope wall and is not returned to the filament, and means for intercepting the infrared energy in the circulating mode and directing it to return to the filament.

2. An electric lamp as in claim 1 wherein the envelope has a generally spherical shape and the circulating infrared energy follows a generally circular path.

3. An electric lamp as in claim 1 further comprising means for dispersing infrared energy which is not returned to the filament by said directing means into a path which will eventually produce circulating mode energy.

4. An electric lamp as in claim 1 wherein said directing means comprises a reflector means having a portion located within the envelope to intercept the infrared energy in the circulating mode and to direct it toward the filament.

5. An electric lamp as in claim 4 wherein the envelope has a neck portion defining an opening in the surface of the envelope wall, said reflector means located in said envelope adjacent said neck portion.

6. An electric lamp as in claim 4 wherein said reflector means comprises a lens for focusing the intercepted circulating mode infrared energy onto the filament.

7. An electric lamp as in claim 4 wherein said reflector means further comprises means for reflecting infrared energy received directly from the filament back to said filament.

8. An electric lamp as in claim 4 wherein said reflector means comprises a generally concave shaped central portion for reflecting the infrared energy received directly from the filament and a plurality of sector pieces for reflecting the circulating energy, each of said sector pieces formed as a lens.

9. An electric lamp as in claim 4 wherein the filament means is vertically mounted, said reflector means shaped to reflect the infrared energy back toward the filament means.

10. An electric lamp as in claim 4 wherein the filament means is horizontally mounted, said reflector means shaped to reflect the infrared energy back toward the filament means.

11. An electric lamp as in claim 4 further comprising means for dispersing infrared energy which is not returned to the filament by said reflecting means into a path which will eventually produce circulating mode energy.

12. An electric lamp as in claim 3 wherein said dispersing means comprises a member mounted adjacent the filament.

13. An electric lamp as in claim 12 wherein said member comprises a grating.

14. An electric lamp as in claim 12 wherein said filament is elongated, said member comprising a flat plate which is mounted radially of the filament.

15. An electric lamp as in claim 14 wherein said member comprises a grating.

16. An incandescent electric lamp as in claim 1 wherein said envelope has a neck portion with an open area from the main portion of the envelope into said neck portion, said infrared energy intercepting means located in said open area and comprising a reflector which is located at an angle to the direction of the circulating mode infrared energy.

17. An incandescent electric lamp comprising:

an envelope, a filament within said envelope, said filament producing energy in the visible range and in the infrared range when heated to incandescence, means connected to and adapted to supply electrical energy to said filament, means for reflecting infrared energy produced by the filament back toward said filament, a portion of said reflected energy which misses impinging upon said filament, and means for intercepting at least a part of said infrared energy which is not returned by said reflecting means to impinge upon said filament and for dispersing the intercepted energy to travel in a path which is generally parallel to the envelope wall.

18. An electric lamp as in claim 17 wherein said intercepting and dispersing means comprises a member mounted adjacent the filament.

19. An electric lamp as in claim 18 wherein said member comprises a grating.

20. An electric lamp as in claim 18 wherein said filament is elongated, said member comprising a flat plate which is mounted radially of the filament.

21. An electric lamp as in claim 20 wherein said member comprises a grating.

* * * * *